US009045859B2

(12) United States Patent
Gauss et al.

(10) Patent No.: US 9,045,859 B2
(45) **Date of Patent: *Jun. 2, 2015**

(54) ADJUSTMENT MECHANISM

(71) Applicant: IBS of AMERICA, Chesapeake, VA (US)

(72) Inventors: Alex Gauss, Chesapeake, VA (US); Hermann M. Vogl, Chesapeake, VA (US); Joshua N. Kruger, Virginia Beach, VA (US); Michael Boehmer, Virginia Beach, VA (US); Andrew S. Forester, Schoolcraft, MI (US); James F. Faufau, Alpharetta, GA (US)

(73) Assignee: IBS of AMERICA, Chesapeake, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/159,779

(22) Filed: Jan. 21, 2014

(65) Prior Publication Data

US 2014/0216676 A1 Aug. 7, 2014

Related U.S. Application Data

(63) Continuation-in-part of application No. 13/987,132, filed on Jul. 1, 2013.

(60) Provisional application No. 61/849,804, filed on Feb. 4, 2013.

(51) Int. Cl.

| | |
|---|---|
| ***D21F 1/00*** | (2006.01) |
| ***D21F 7/00*** | (2006.01) |
| ***D21F 1/48*** | (2006.01) |

(52) U.S. Cl.
CPC . *D21F 7/00* (2013.01); *D21F 1/486* (2013.01)

(58) Field of Classification Search
USPC ..... 162/348, 352, 374, 380
See application file for complete search history.

(56) References Cited

U.S. PATENT DOCUMENTS

| | | | |
|---|---|---|---|
| 3,017,390 | A | 1/1962 | Ehlers |
| 3,323,982 | A | 6/1967 | Hill |
| 3,520,775 | A | 7/1970 | Truxa |
| 3,535,201 | A | 10/1970 | Reynolds et al. |
| 3,573,159 | A | 3/1971 | Sepall |
| 3,647,620 | A | 3/1972 | Truxa |
| 3,922,190 | A | 11/1975 | Cowan |
| 4,184,915 | A | 1/1980 | Metcalf |
| 4,416,731 | A | 11/1983 | Pesonen et al. |
| 4,559,105 | A | 12/1985 | Sennett et al. |
| 4,838,996 | A | 6/1989 | Kallmes |
| 5,080,760 | A | 1/1992 | Smith et al. |
| 5,169,500 | A | 12/1992 | Mejdell |
| 5,735,330 | A | 4/1998 | Buchmann et al. |
| 5,830,322 | A | 11/1998 | Cabrera y Lopez Caram et al. |
| 5,922,173 | A | 7/1999 | Neun et al. |
| 5,951,823 | A | 9/1999 | Cabrera y Lopez Caram et al. |
| 6,030,501 | A | 2/2000 | Neun et al. |
| 6,126,786 | A | 10/2000 | White et al. |
| 6,478,928 | B1 | 11/2002 | Sbaschnigg et al. |
| 6,982,025 | B2 | 1/2006 | Pitt |
| 6,988,018 | B2 | 1/2006 | Eames |
| 7,993,492 | B2 | 8/2011 | Cabrera y Lopez Caram et al. |
| RE43,679 | E | 9/2012 | VanEssen et al. |
| 8,551,293 | B2 | 10/2013 | Faufau et al. |
| 8,685,209 | B2 | 4/2014 | Faufau et al. |
| 2002/0066546 | A1 | 6/2002 | Forester |
| 2003/0116295 | A1 | 6/2003 | Eames |
| 2003/0136539 | A1 | 7/2003 | Bartelmuss et al. |
| 2005/0150627 | A1 | 7/2005 | Frawley et al. |
| 2011/0186254 | A1 | 8/2011 | Cabrera y Lopez Caram et al. |
| 2012/0267065 | A1 | 10/2012 | Faufau et al. |
| 2013/0042987 | A1 | 2/2013 | Cabrera y Lopez Caram et al. |
| 2014/0034261 | A1 | 2/2014 | Faufau et al. |
| 2014/0202648 | A1 | 7/2014 | Faufau et al. |
| 2014/0216675 | A1 | 8/2014 | Gauss et al. |
| 2014/0216676 | A1 | 8/2014 | Gauss et al. |

FOREIGN PATENT DOCUMENTS

| | | | |
|---|---|---|---|
| DE | 4440944 | A1 | 6/1995 |
| EP | 539027 | A2 | 4/1993 |
| WO | 2007/088456 | A1 | 8/2007 |
| WO | 2008/118303 | A1 | 10/2008 |

OTHER PUBLICATIONS

Extended European Search Report, Application No. 14153883.5 mail date Apr. 28, 2014.

(Continued)

*Primary Examiner* — Mark Halpern
(74) *Attorney, Agent, or Firm* — The Dobrusin Law Firm, PC

(57) ABSTRACT

An adjustment mechanism comprising: (a) a lower pultrusion; (b) an upper pultrusion; and (c) a plurality of cam blocks located between the lower pultrusion and the upper pultrusion; wherein the plurality of cam blocks are longitudinally movable relative to the lower pultrusion and the upper pultrusion so that as the plurality of cam blocks longitudinally move, at least a portion of the upper pultrusion moves away and/or angularly relative to the lower pultrusion.

20 Claims, 8 Drawing Sheets

(56) References Cited

OTHER PUBLICATIONS

Pruitt, M., "How fourdrinier table control affects strength and speed on linerboard—Green Bay Packaging's Morriton, AR, mill" Nov. 30, 2008, available at: http://www.risiinfo.com/magazines/November/2008/PP/PPMagNovember-How-fourdrinier-table-control-affects-strength-and-speed-on-linerboard.html, last accessed Mar. 20, 2013.

IBS Paper Performance Group, Product Brochure, 2005.

Potentially Related Application, U.S. Appl. No. 14/039,236, filed Sep. 27, 2013.

Office Action Summary, U.S. Appl. No. 13/987,132 dated Sep. 5, 2014.

ADJUSTMENT MECHANISM

FIELD

The present teaching relate to a system and method for angle and/or height controlling dewatering mechanisms in a paper machine and preferably a Fourdrinier paper machine.

BACKGROUND

The forming or wet section of a Fourdrinier consists mainly of the head box and the forming wire, or fabric. Its main purpose is to generate consistent slurry, or stock, for the forming wire. A breast roll, several foils, suction boxes and a couch roll commonly make up the rest of the forming section. The press section and dryer section follow the forming section to further remove water from the paper sheet. The paper pulp is deposited atop the forming wire or a forming fabric. The pulp is then dewatered to create a paper sheet.

Adjustable foils have been utilized previously for dewatering operations in Fourdrinier machines. For instance. U.S. Pat. No. 5,169,500 to Mejdell, incorporated by reference herein for all purposes, which discloses an angle adjustable foil for a paper making machine. In Mejdell, a rigid foil member is pivoted by a cam actuated adjustment mechanism to change the angle of the foil blade. This moves the foil blade in the cross-machine direction which opens gaps that allows stock that includes fibers, filler, and fines into the foil blade mechanism where internal componentry may become clogged and cease to operate properly. Additionally, when fibers, fines, and fillers are introduced into the mechanism it may create high spots and/or opposing low spots where the blade is in contact with some portions of a wire across the cross-machine direction and not in contact with other portions of the wire resulting in a loss of dewatering to the paper sheet in such areas, if fibers, fines, and fillers become trapped within the foil blade the range of motion, over time, may become impeded such that the foil blades may cease to adjust along a full range or even break or require maintenance to restore a range of motion. It would be attractive to have a foil blade that is not susceptible to contamination by material in stock such as fibers, fines, and/or fillers. It would be attractive to have a foil blade that is adjustable such that fibers, fines, and fillers, located within the foil blade do not affect adjustment of the foil blade. What is needed is a foil blade system that maintains a substantially level nature across the machine direction of a paper machine so that the foil blade provides consistent dewatering along an entire cross-machine direction of the paper machine.

SUMMARY

An adjustment mechanism comprising: (a) a lower pultrusion; (b) an upper pultrusion; and (c) a plurality of cam blocks located between the lower pultrusion and the upper pultrusion; wherein the plurality of cam blocks are longitudinally movable relative to the lower pultrusion and the upper pultrusion so that as the plurality of cam blocks longitudinally move, at least a portion of the upper pultrusion moves away from the lower pultrusion.

An adjustment mechanism comprising: (a) a lower pultrusion including: (i) one or more recesses for receiving a portion of a paper machine; (b) one or more glide shoes in communication with the lower pultrusion; (c) a plurality of cam blocks in communication with the one or more glide shoes, wherein the plurality of cam blocks are movable along the one or more glide shoes and the lower pultrusion, each of the plurality of cam blocks comprising: (i) a groove on a first side extending from a proximal end to a distal end of the cam block and (ii) a groove on a second side extending from a proximal end to a distal end of the cam block; (d) one or more connecting rods extending along a longitudinal axis of the adjustment mechanism and connecting each of the plurality of cam blocks; (e) glide shoes located on the first side and the second side of the cam block, wherein one glide shoe extends into each of the grooves of the plurality of cam blocks; (f) an upper pultrusion connected to the glide shoes and in communication with the plurality of cam blocks via the glide shoes; and (g) a foil in communication with the upper pultrusion; wherein during adjustment of the upper pultrusion the plurality of cam blocks are moved along the longitudinal axis within the glide shoes and an orientation of the glide shoes is changed so that the upper pultrusion is adjusted without the upper pultrusion moving along the longitudinal axis.

The improved devices of the present mechanism includes an upper pultrusion assembly arranged atop a lower pultrusion assembly to create a recess which contains a plurality of parts arranged therein to yield an adjustment mechanism. The adjustment mechanism includes cam blocks, an actuator and associated couplers, guide keys, a connecting rod and glide shoes. Each cam block includes a pair of inclined planar grooves and rides atop a glide shoe such that the cam blocks may be slid toward a driven end or in an opposite direction to adjust either the height of a respective foil or an angle of a respective foil, according to whether the sloped grooves are utilizing the same angle, or different angles. Each planar groove includes an open side to allow the fasteners of the guide key to pass there through. One of the inclined grooves is provided on a first face of the cam block; the other inclined groove is arranged on an opposite face of the cam block. Guide keys are affixed on an interior surface of the upper pultrusion and extend into the inclined grooves to communicate with the cam blocks and raise/lower or adjust and angle of the upper pultrusion as the cam blocks move in a respective direction. The guide keys are fixedly connected to the upper pultrusion so that longitudinal movement of the cam block moves the upper pultrusion relative to the lower pultrusion. Thus, the invention may be realized as two separate embodiments; one for adjusting a foil height when the slopes of the inclined grooves present on the sides of the cam blocks are equal and the other for adjusting a foil angle when the slopes of the inclined grooves on the front and trailing edges of the cam blocks are unequal. That is, the rate of change of the front and trailing edges are equal when the cam blocks are driven from one side to the other side of the Fourdrinier.

An actuator forming part of the improved adjustment mechanism is arranged at one end of the lower pultrusion assembly and is linked to a connecting rod that pushes or pulls the cam blocks along a longitudinal axis (e.g., along a respective cross-machine direction) to effect the height or angle adjustment of a particular foil. In this manner, the inclined planar grooves of each cam block assist in causing a change in height or angle of the upper pultrusion assembly. An end of the lower pultrusion assembly, opposite to the actuator, is provided with an indicator means for visually observing the angle or height of the foil. This indicator may include a modified rod with measuring rings which indicate a height or angle. Otherwise, the indicator may include marks on an end plate. It should be recognized that certain modifications may be undertaken to the instant invention. For instance, a manual adjustment mechanism may be provided at one end of the lower pultrusion assembly in lieu of the motorized actuator.

The upper pultrusion assembly may include one or more surfaces, which atop the upper support pultrusion assembly, referenced throughout as upper pultrusion. The upper support pultrusion typically comprises a fiberglass composite material or fiber reinforced material. A scraper and its associated holder may be affixed onto opposite sides or faces of the upper support pultrusion assembly. Each scraper directs fluids and contaminants away from where the upper pultrusion assembles to the lower pultrusion. The upper support pultrusion assembly is formed in an elongated manner, having a complementary shape to accept the upper side of the cam blocks such that when the cam blocks are withdrawn to one side of the Fourdrinier, the foil is aligned at for instance either a zero height in elevation or a −1 degree angle depending on the particular height or angle adjustment application. It is should be noted that the reference points and ranges for the heights and angles may be adjusted according to user needs and that any set forth in this application should be considered for illustrative purposes and not in a limiting sense. When the cam blocks are forced towards the side opposite the actuator, the inclined grooves of the cam blocks communicate with guide keys fastened to the interior side of the upper support pultrusion assembly to raise the height of the foil or change the angle. If the slope of the inclined grooves of the leading and trailing edges are equal then a height adjustment mechanism may be realized. Otherwise, if the included grooves are unequal then an angle adjustment mechanism may be implemented. Raising and lowering the foil or adjusting the angle of the foil to the stock suspension that (e.g., wire) manipulates drainage and fiber alignment in the sheet forming process.

Two separate embodiments are realized by sloping the inclined grooves of the cam blocks in either direction across the paper machine. That is, a height adjustable foil may be implemented by providing cam blocks with a front and rear face having inclined grooves formed therein. The inclined grooves slope from one side to the other while maintaining the same degree of slope of the inclined groove on both faces. In an angle adjustment embodiment, the inclined grooves formed in the surfaces of the faces of the cam blocks may incorporate different angled grooves and sloped as shown in the drawings. That is, an angle adjustable foil may be implemented by sloping the inclined grooves on opposite faces of the cam blocks at different angles causing the rate of change from the front end of the foil to vary from that of the back end. This forces a larger amount of displacement on, for example, the leading edge of the foil to occur thereby allowing an operator to adjust the angle at which the edges of the foil contact the underside of the forming wire or sheet. By maintaining a height difference between the leading and trailing edges of the foil(s), an angle adjustable embodiment is realized, while maintaining a static lead-in blade position.

The teachings provide an improved process and mechanism for controlling the angle of an adjustable angle foil to achieve a better paper quality by adjusting the angle to create a desirable result in the paper forming process.

The teachings herein provide processes and mechanisms for controlling the height of an adjustable height foil to achieve a better paper quality.

It is a further object of the invention to teach a Fourdrinier having adjustable on-the-run mechanisms for adjusting the height and angle of foils or blades to easily switch over operation of the Fourdrinier to produce paper of various qualities and types without shutting down and restarting the machine. This on-the-run adjustment saves substantial energy costs and realizes a more energy efficient paper producing method of the paper machine. The present teachings provide a foil blade that is not susceptible to contamination by fibers, fines, and/or fillers found in the paper manufacturing process. The present teachings provide a foil blade that is adjustable such that fibers, fines, and fillers, located within the foil blade do not affect adjustment of the foil blade. The present teachings provide a foil blade system that maintains a substantially level nature across the machine direction of a paper machine so that the foil blade provides consistent dewatering along an entire cross-machine direction of the paper machine.

Additional objects and advantages of the invention will be set forth in part in the description, which follows, and in part will be obvious from the description, or may be learned from practicing the invention. The objects and advantages of the invention will be obtained by means of instrumentalities in combinations particularly pointed out in the appended claims.

DETAILED DESCRIPTION

Figure 1A:
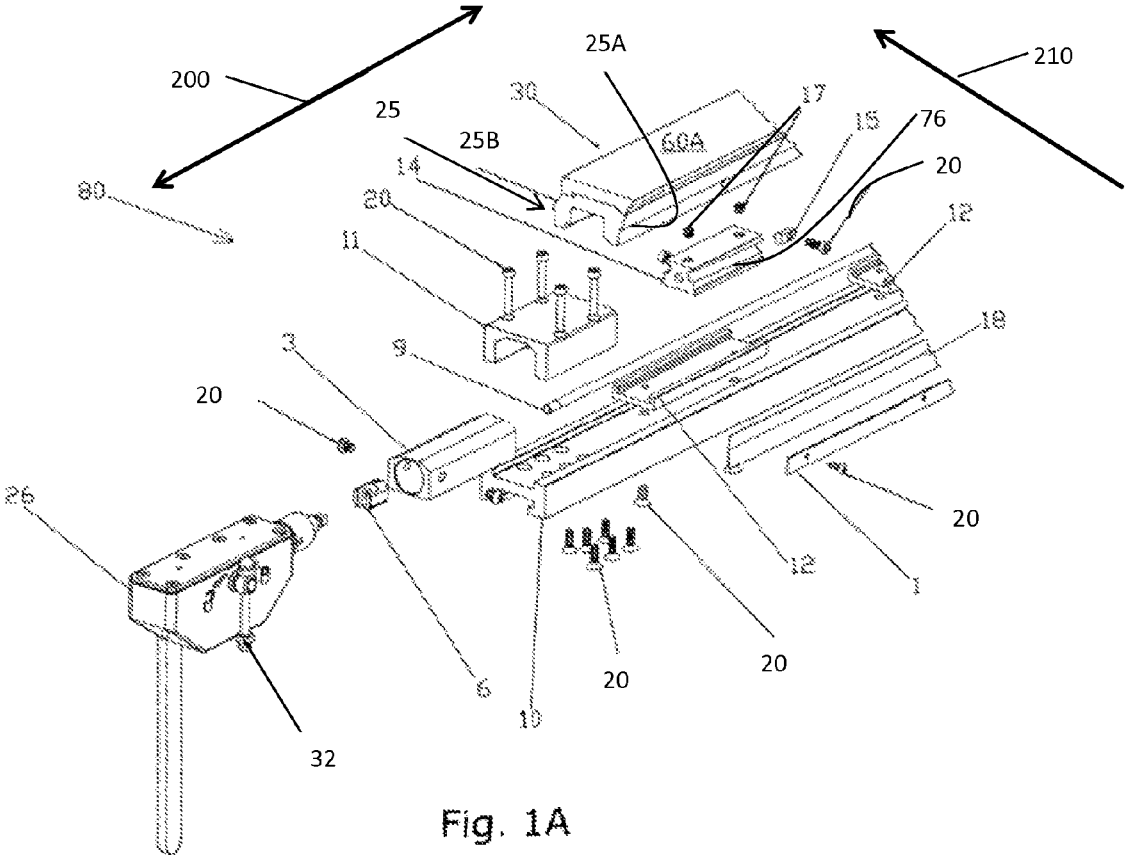
FIG. 1A illustrates a partial exploded view of a foil angle adjustment mechanism and taken from the foil drive end.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The embodiments of the invention and the various features and advantageous details thereof are more fully explained with reference to the non-limiting embodiments and examples that are described and/or illustrated in the accompanying drawings and set forth in the following description. It should be noted, that the features illustrated in the drawings are not necessarily drawn to scale, and the features of one embodiment may be employed with the other embodiments as the skilled artisan recognizes, even if not explicitly stated herein. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

For purposes of this application, the term "machine direction" with respect to the Fourdrinier extends from the front "wet" end to the rear "dry" end, "Cross-machine direction" extends from one side of the paper machine to the opposite side thereof. The device of the present teachings may be part of a new system or may be retrofit and installed in an existing system (e.g., an existing "T" bar or "C" channel). The device of the present teachings may be self-cleaning. Preferably, the device of the present teachings includes self-cleaning cam blocks.

The cam blocks may include one or more grooves. Preferably, the cam blocks include a pair of sloped grooves on opposite sides of a cam block that are oriented to move in the cross-machine direction and driven from side-to-side in the cross-machine direction to either adjust an angle or a height of a foil blade for improved dewatering purposes. The one or more grooves may include closed ends. More preferably, the one or more grooves include open ends on a distal end, a proximal end, or both so that movement of the guide keys clean the grooves. Even more preferably, the grooves may be self-cleaning so that any paper by-products (e.g., fiber, fines, paper chemicals, filler, or a combination thereof) may be removed from the grooves during adjustment of the upper pultrusion, the lower pultrusion, or both. The grooves each include a proximal end and a distal end. The proximal end and the distal end may be substantially in the same plane. The distal end and/or proximal end may be located above the other respectively, in a different plane, or both so that the groove extends at an angle between the distal end and the proximal end. The slope between the proximal end and the distal end may be about 0.1 or more, about 0.5 or more, or even about 1 or more absolute. The slope between the proximal end and the distal end may be about 10 or less, about 5 or less, or about 1 or less absolute. An angle may be formed between the distal end and the proximal end and the angle may be substantially 0 degrees, about 5 degrees or more, about 10 degrees or more, or about 15 degrees or more. An angle between the distal end and the proximal end may be about 60 degrees or less, about 45 degrees or less, or about 30 degrees or less.

For purposes of this application, the term "pultrusion" refers to a manufacture of composite materials having a constant cross-section. Likewise, the terms "leading edges" and "trailing edges" used with respect to the term cam block refers to the left and right sides of the cam block when viewed from either side of the Fourdrinier and are referenced to a machine direction (i.e., the direction paper moved along the paper machine during formation).

For illustrative purposes only, the invention will be described in conjunction with a Fourdrinier papermaking machine although the invention and concept could also be applied to other forming machines. The invention is preferably implemented in the wet section of the Fourdrinier which includes a forming board section, a hydrofoil section, and a vacuum section.

The teachings herein provide an adjustment mechanism. The adjustment mechanism may be any device that functions to change an angle, a height, an orientation, or a combination thereof of an upper pultrusion, a foil, or both. The adjustment mechanism may be an integral part of an upper pultrusion, a lower pultrusion, or both. Preferably, the adjustment mechanism is incorporated into and includes an upper pultrusion and a lower pultrusion. The adjustment mechanism may be a height adjustable device, an angle adjustable device, or both. An angle adjustable device may include an upper pultrusion assembly, an angle or height adjustment mechanism, and a lower pultrusion assembly. Parts as discussed herein for the height adjustable device may be used in the angle adjustable device and vice versa. The upper pultrusion includes a leading edge and a trailing edge. During adjustment of the angle adjustable blade the trailing edge may be moved while the leading edge remains static. For example, the leading edge (i.e., first edge contacted by a sheet traveling in the machine direction) may maintain contact with a wire, a sheet, or both and the trailing edge may be moved towards and/or away from the wire, the sheet, or both to dewater the sheet, affect fiber orientation, or both. In another example, the leading edge may act as a pivot point and the blade may pivot about the leading edge. The upper pultrusion, lower pultrusion, or both include a longitudinal axis that runs along a length of the upper pultrusion. The longitudinal axis may be parallel to and/or extend in the same direction as the cross machine direction. A closed top may be formed between the leading edge and trailing edge and includes an upper surface to which either a single foil is affixed. The upper pultrusion and lower pultrusion may be formed by extrusion, pultrusion, molding, the like, or a combination thereof.

In the angle adjustment embodiment, a single foil may be arranged atop the closed top of the upper pultrusion. A pair of foils may be arranged on opposite sides of the upper pultrusion in the height adjustable embodiment. Each of the upper pultrusions may include a different shape depending on the type of adjustment and dewatering the upper pultrusion performs. For instance, the exterior surface of the top of pultrusion may include a flat stepped region for accommodating the recessed portion of the underside of foil. In the height adjustable foils, the upper surface of the upper pultrusion may be sloped from side-to-side with a lower region formed in the exterior top and includes steps on either side for accommodating a pair of foils. The upper surface may include two opposing slopes that slope towards a central region. The foils may be fastened to the upper exterior of the upper pultrusion with any fastener taught herein. The interior workings of both upper pultrusions may be the same for both the height and angle adjustable embodiments. For example, as the cam block moves along the longitudinal axis the cam block may move the upper pultrusion relative to the lower pultrusion (i.e., vertically up or down or towards or away from each other) without the upper pultrusion moving longitudinally. In another example, the guide keys may be fastened to the interior recess of the upper pultrusions in both embodiments and adjust a respective foil's angle or height as a plurality of cam blocks move across one or more glide shoes and preferably a plurality of glide shoes.

The glide shoes may be fixedly connected to the upper pultrusion, the lower pultrusion, or both via one or more fasteners (e.g., screws, bolts, an adhesive, a threaded member, a set screw. the like or a combination thereof). The glide shoes may be any device that functions to retain the one or more cam blocks and preferably a plurality of cam blocks within the adjustment mechanism while along the cam blocks to move along the longitudinal axis. The glide shoes may be an integral part of the upper pultrusion, the lower pultrusion, or both. For example, the glide shoes may be molded, cast, pultruded, or the like when the upper pultrusion and/or lower pultrusion are created. Preferably, the glide shoes are fixedly connected to the lower pultrusion. The glide shoes may include one or more locking features that movingly lock the cam blocks within the glide shoes that that the glide shoes retain the cam block within the glide shoes as the glide shoes longitudinally move. The glide shoes may include a distal end stop, a proximal end stop, or both so that the cam blocks are retained within the glide shoes and prevented from exiting the glide shoes. Each guide key is located within a respective sloped track that are formed on the opposite faces of a cam block and receive a respective guide key. For example, each groove of each cam block may include one guide key. A pair of guide keys are arranged substantially equidistance from an end of the upper pultrusion. Enough pairs of guide keys are arranged within the upper pultrusion to ensure accurate adjustments of either the angle or height along the entire length of the upper pultrusion.

The upper pultrusion may function to support a foil, substantially surround a cam block, have a complementary relationship with a lower pultrusion, or a combination thereof. The upper pultrusion may be sufficiently rigid so that as the height and/or angle of the upper pultrusion is adjusted; the upper pultrusion is maintained in a constant plane, along a plane, straight, or a combination thereof. For example, the upper pultrusion may maintain the foil at a constant distance from a wire along the cross-machine direction so that a constant level of dewatering is performed across a length (i.e. cross machine direction) of the paper machine. The upper pultursion may be made of any material that is fluid resistant; corrosion resistant; will withstand the chemicals, alkalinity, corrosive nature, abrasion, or a combination thereof of the papermaking process. Preferably, the upper pultrusion support assemblies may be formed of fiberglass reinforced composite and shaped in an inverted U-shape (when viewed from either end) to span across the entire width of the Fourdrinier. The upper pultrusion assembly may include sloped exterior edges arranged on the leading and trailing faces with a stepped region that accepts one or more scrapers, one or more holders, or both. A scraper, a seal, or both may be provided on either face of the upper pultrusion support assemblies and may be secured thereto via fasteners and a scraper holder, a seal holder, or both that may prevent debris, liquid, pulp, chemicals, and the like from entering into the device. One or both upper pultrusion support assemblies may include a stepped region on the interior of the leading and trailing faces to accommodate the glide shoes and allow the upper pultrusions to be adjusted. The upper exterior of the upper pultrusion may include a pair of angled edges for securing the foil atop the upper pultrusion. In the height adjustment embodiment, the angles may be substantially ninety degrees; whilst in the angle adjustment embodiments the angles may acute.

The lower pultrusion assembly may function to connect the angle adjustment mechanism, height adjustment mechanism, or both to a forming section, a paper machine, or both. The lower pultrusion assembly may form any connection so that the upper pultrusion may move relative to the lower pultrusion, and the lower pultrusion may provide a sufficient amount of support to the upper pultrusion so that the upper pultrusion is adjustable. Preferably, during adjustment of the adjustment mechanism the upper pultrusion, the lower pultrusion, or both are maintained longitudinally static while lateral adjustments are made. The lower pultrusion assembly may be an elongated member formed to include a T-shape, a C-shape, or both recess on its underside for accepting T-bar and/or and/or C-connector of the forming section, the paper machine, or both. A U-shaped recess (when viewed from either end and/or cross-section) may be formed on an upper side of the lower pultrusion, the upper pultrusion, or both. Fasteners may pass through a respective through hole opening in the lower pultrusion to secure a glide shoe to a portion of the upper surface of the lower pultrusion assembly within the U-shaped recess. Fasteners may secure an end plate to one end of the lower pultrusion. A thrust end block and/or pivot thrust block may be secured to a region of the upper surface of the lower pultrusion assembly via fasteners. Preferably, the pivot thrust block is connected to the upper pultrusion and the thrust end block is connected to the lower pultrusion so that movement of the upper pultrusion in the cross machine direction is prevented during height and/or angle adjustment. A manual actuator or automatic actuator such as motor may be in communication with the upper side of the lower pultrusion assembly and may be arranged at an opposite end of the lower pultrusion assembly to end plate. The angle or height adjustment mechanism may include one or more of the following: glide shoes, the thrust end block, drive adapter, pivot end block, cam blocks, connecting rod, actuator or motor, end plate and the guide keys, as well as any associated respective fasteners. However, the devices may be adjusted via actuators, which may be manually operated by means of manual actuators or preferably with one or more motors that may be controlled through a programmable microprocessor. The term motor as discussed herein should be construed to include electric, pneumatic, hydraulic, and the like.

The angle adjustment mechanism, height adjustment mechanism, or both may include a manual gear box. The manual gear box may be any device that functions to allow a user to adjust the angle and/or height of an adjustment mechanism so that a foil is moved relative to a wire so that paper drainage is affected. The manual gear box may be provided in place of the motor for manually adjusting the height or angle of the foil. The manual gear box may include a handle and locking mechanism. A coupler may transmit torque from either the motor or manual gear box through the drive adapter and onto the connecting rod that extends along a longitudinal axis. The one or more connecting rods may simultaneously move one or more and preferably a plurality of cam blocks along a longitudinal axis. The one or more connecting rods may move the one or more cam blocks through the recess in the upper pultrusion and/or lower pultrusion while both the upper pultrusion and the lower pultrusion remain substantially static in the cross-machine direction. A drive adapter may support an end of connecting rod and the driver adapter may connect within a recess. Linear movement of the connecting rod may be transmitted to move the cam blocks across the glide shoes thereby adjusting either the height or angle of the foil by causing the guide keys to move within grooves between a distal end and a proximal end of the grooves, which may be part of an interior surface of the upper pultrusion so that the upper pultrusion rises and falls. The proximal end may be located on the same plane as a distal end. The proximal end may be higher than a distal end or vice versa. The proximal end may be located on a side of a cam block near a drive adapter. A drive adapter may include a yoke that accepts an end of the manual gear box (actuator) or motor. The drive adapter may be cylindrical or any other shape so that the drive adapter fits into a recess (e.g., cylindrical recess) formed in an end of drive adapter. The drive adapter may be elongated and may include a flattop having sloped edges on either side thereof. An end of connecting rod may extend into the end of the drive adapter opposite the recess. The glide shoes may provide a reduced friction surface over which the cam blocks move so that height or angle of the foil is adjusted. Fasteners such as set screws may pass through openings in the upper surface of the cam blocks to lock cam block onto the connecting rod. Guide keys may be fastened to the interior vertical sides of the upper pultrusion via threaded fasteners to moveably mate with the sloped surfaces of a respective cam block such that lateral movement of the connecting rod is transmitted to the cam blocks which in turn adjusts the height or angle of the upper pultrusion. The guide keys may be operationally arranged within the sloped grooves on the sides of the cam blocks such that as the cam blocks slide across the glide shoes and/or the glide shoes move within the grooves, the upper pultrusion is raised, lowered, or angle adjusted with respect to a forming fabric or wire and the sheet. The guide keys may be arranged in opposing pairs. For example, each pair includes one guide key on the interior surface of the leading edge and the other guide key on the trailing edge of the upper pultrusion. The pairs of guide keys are arranged at predetermined distances. The number of pairs of guide keys necessary for implementing either embodiment of the invention will vary according to the width of the particular Fourdrinier and the length of the pultrusions necessary to span that length. Each pair is preferably spaced at uniform distance from its preceding and/or succeeding pair and/or one of the ends of the device along the interior of the upper pultrusion. The guide keys are conical in shape with a flat side and include a pointed end. A through opening is provided in the flat side of each guide key for receiving a threaded end of a fastener that couples the guide key to the upper pultrusion.

End seals may be arranged between the "upper pultrusion" and "lower pultrusion" at opposite ends thereof and fastened there between via fasteners. The end seals may be a complementary shape to receive drive adapter and pivot thrust block or thrust end block. A plurality of through openings may be provided in each end seal for accommodating fasteners which couple the respective end seal to the upper surface of the lower pultrusion. The end seals serve a similar function to that of the seal in preventing debris, pulp, water and the like from entering the device at the ends. Fasteners may connect a pivot thrust block or thrust end block at an end of the lower pultrusion or the upper pultrusion opposite the drive end. The pivot thrust block may include a fastener opening with an open bottom for receiving an end of a connecting rod to provide support therefor. The open bottom may allow the pivot thrust block to move up and down while lateral movement (i.e., movement in the cross machine direction) is prevented by the thrust end block. The one or more thrust end blocks may include a flat bottom and vertical sides which form a yoke and having openings in both sides for receiving an end of the connecting rod and an end of the indicator rod. A pivot thrust block may rest inside the yoke and operably couples the connecting rod and indicator rod together. One end of the connecting rod may extend into the pivot thrust block or thrust end block, while the end of an indicator rod may extend from an opposite side of the pivot thrust block or thrust end block. The position of the indicator rod may be controlled by the connecting rod such that an operator can determine either the height or angle of the foil from an end of the assembly opposite the drive end. One or more fasteners may couple a drive adapter to an upper surface of the lower pultrusion. One or more fastener may fix one or more couples within a drive adapter. Each cam block may include a pair of sloped grooves on either its face or side. The underside of the lower pultrusion assembly may include a T-shaped recess into which a T-bar, mounted atop the Fourdrinier, is inserted. A C-shaped channel may be utilized in place of the T-bar for securing the lower pultrusion assembly to the top of the Fourdrinier. The T-bar and C-shaped channel is preferably formed from stainless steel and rests atop the frame of the Fourdrinier. Seals are arranged at opposite ends of the devices and prevent debris from clogging the adjustment mechanisms. The indicator rod may comprise a hollow end into which the end of the connecting rod may be seated to couple the two together.

The motor may be controlled via motor control circuitry or a programmable microprocessor. The actuator may be fixed to the lower pultrusion assembly to push or pull the sliding cam blocks across the low friction glide shoes to engage the sloped grooves of the cam blocks with the keys inside the recess on the underside of the upper pultrusion assembly. The term "low friction" means a reduced friction surface that allows the cam block to easily slide from side-to-side within the enclosure created by the upper recess of the lower pultrusion and the recess of the upper pultrusion. A connecting rod may connect the various cam blocks together. The cam blocks may be fastened via one or more fasteners at predetermined intervals along the length of the connecting rod. The angle or height of the surface may be changed as the cam blocks with their sloped grooves move over the glide shoes and raise or lower the upper pultrusion assembly. A plurality of cam blocks and glide shoes may be arranged across a lower pultrusion assembly to ensure uniform adjustment of the entire foil. The indicator rod may extend through the end plate and visually indicates a position of the angle or height on an end opposite the actuator. A digital indicator may be used in lieu of and/or in addition to an indicator rod. For example, a transmitter may be placed on the foil and as the foil is moved the indicator may provide a digital read out of the position to a monitor, a display, a computer, the like, or a combination thereof. The indicators may be monitored remotely (i.e., at a location other than next to the machine). The indicators may measure in any increment or fraction of an increment so that the blades may be accurately adjusted. The indicators may be connected to the blade, the connecting rod, or both to measure the position of the blades.

The connecting rod may be withdrawn so that the foil for example, assumes height of zero mm with respect to the underside surface of a forming fabric or the like. The actuator may extend the connecting rod to drive the cam blocks across the glide shoes causing the upper pultrusion assembly and foil to be lowered to a height discussed herein such as of about −4 mm. The one or more glide shoes may create an end stop for the one or more cam blocks so that the cam blocks are restricted from exiting the glide shoes, a maximum height of the upper pultrusion is restricted, or both. The upper pultrusion assembly may be attached to the guide keys which communicate with the sloped edges of the cam blocks and the height or angle of the foil is varied when the cam blocks are driven via the connecting rod in a first direction. For example, the upper pultrusion assembly returns to its initial state when the connecting rod is driven in a direction opposite the first direction. Thus, the height of the foil blade with respect to a forming fabric may be changed. The slope of grooves may be equal to cause the leading and trailing faces of the upper pultrusion to uniformly be raised or lowered as the cam block moves across the glide shoe. The shape of the upper pultrusion may include a stepped region on either side that extends outward to provide an overhang over the upper edges of the scraper and scraper holder. The holder may extend between the upper pultrusion and the lower pultrusion and cover any spaces extending therebetween. The spacer and a scraper in combination may cover the space between the upper pultrusion and the lower pultrusion. The spacer may substantially prevent paper making by products (e.g., filler, fiber, chemicals, fines, or a combination thereof) from extending into the space between the upper pultrusion and the lower pultrusion. This overhang advantageously drains materials away from the opening between the upper and lower pultrusions which is covered by the scraper. A sloped edge may be provided on each of the faces and terminate beneath the foil which are arranged in a shelf formed in the upper edge of the upper pultrusion. The top of the upper pultrusion is sloped between the two shelves as shown.

The connecting rod may be withdrawn and the angle adjustable foil blade may assume and angle, for example, of about +0.5 degree. When energized, the actuator may push the cam blocks across the glide shoes such that the sloped grooves change the angle to −3.5 degrees. The angle and/or height of the foil blades may be adjusted by any incremental distance as discussed herein. The angle and/or height of the foil blades may be moved between a position of being free of contact with a wire to a position of lifting a wire. An angle adjustment mechanism may vary the angle of the foil from an angle from about −10° to about 10°, preferably from about −5° to about 5°, and more preferably from about −5° to about 1°. The angle adjustment mechanism may infinitely change the angle in increments of 0.1° or more, 0.2° or more, 0.3° or more, or even about 0.5° or more. The angle adjustment mechanism may change the angle in increments of about 1° or less, about 0.8° or less, or about 0.6° or less. Thus, the angle adjustment mechanism may infinitely change the angle of the foil to angles from +1° to −5°). or any combination of increments discussed herein. The angle of the grooves on opposite sides of the cam blocks being unequal, thus the angle of the foil with respect to the forming fabric may be varied.

The height adjustment mechanism may adjust the height adjustment mechanism from a height of about −1 mm to about 10 mm, from about −0.5 mm to about 5 mm, or from about 0 mm to about 4 mm. The height adjustment mechanism may be adjustable in any increments of about 0.1 mm or more, about 0.2 mm or more, or about 0.3 mm or more. The height adjustment mechanism may be adjustable in increments of about 1 mm or less, about 0.7 mm or less, or about 0.5 mm or less. Thus the height adjustment mechanism may infinitely change the height of the foil to heights of about −1 mm, −0.5 mm, 0 mm, 0.5 mm, 1 mm, 1.5 mm, 2 mm, 2.5 mm, 3 mm, 3.5 mm, 4 mm, or any combination of increments discussed herein. The angle of the grooves on opposite sides of the cam blocks may be equal, thus the height of the foil with respect to the forming fabric may be equal. The foils may be any device that may withstand the paper making environment, be used to dewater stock, resist abrasion from a paper wire, or a combination thereof. The foil may be made of ceramic, polymer, poly, other suitable material and include metal, be free of metal, or a combination thereof. The orientation (i.e., height and/or angle) of the foil as discussed herein may be changed by the grooves of the cam block and the cam block laterally moves within the adjustment mechanism.

In the preferred embodiment, the sloped grooves of the cam blocks are externally arranged and extend from either side-to-side or end-to-end. Likewise, certain modifications of the cam blocks may be realized by arranging the sloped surfaces on an interior recess of the cam blocks and the connecting rod may be driven into these sloped grooves to cause the change in either height or angle, respectively. The upper pultrusion may include a stepped region on the inner lower surface for accommodating the upper surface of the glide shoe. A stepped region is also provided on opposite edges as in the alternative embodiment. A scraper, a seal, or both and its associated holder may be provided on the leading edge of the upper pultrusion. A sloped region with a thicker upper edge over extends above the scraper, the seal, or both and the respective holder. A sloped edge also extends below the foil. The upper surface of the upper pultrusion includes a track comprising sloped sides and onto which the foil attaches.

The cam blocks may move laterally across the glide shoes. The guide keys may operationally mate with the sloped grooves on opposite sides of the cam blocks to effect either a height change or an angle change of the foil with respect to a forming fabric.

A plurality of the cam blocks, guide keys, glide shoes, and the connecting rod may be arranged across the entire mechanism to ensure uniform adjustments across the entire upper face of the foil (i.e., the cross-machine direction).

The drives, pistons or motors may be electric and hydraulic may include a supply lines to practice the invention. In the height adjustment device, the adjustable blades are raised or lowered to cause them to intersect with the underside of the forming fabric at a predetermined height to influence the alignment of the fibers within the paper web. The height of the adjustable blades may be changed to ensure that the paper fibers are aligned in a desired direction. Changing the height settings will directly influence the fiber orientation in the paper sheet. Likewise, the angle of certain foils may be adjusted according to a desired characteristic in the paper grade. Moreover, the quantity of parts may vary according to the length of the foil.

It is to be understood that the invention is not limited to the exact construction illustrated and described herein, but that various changes and modifications may be made without departing from the spirit and the scope of the invention as defined in the following claims. While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

FIG. 1A is an exploded view of an angle or height adjustable mechanism 80. The angle or height adjustable mechanism 80 includes a manual gear box 26 for manually adjusting the angle or height of the angle or height adjustable mechanism 80. The manual gear box 26 includes a locking lever 32 so that once the height or angle is set the angle or height adjustable mechanism 80 is prevented from moving. The manual gear box 26 is in communication with a couple 6 that is located within and connected to a drive adaptor 3 by one or more fasteners 20. The drive adaptor 3 is connected to a lower pultrusion 10 by a plurality of fasteners 20. The drive adaptor 3 assists in connecting a connecting rod 9 to the coupler 6 so that the manual gear box 26 can move the connecting rod 9. An end seal 11 extends over the top of the drive adaptor 3 and fasteners 20 assist in connecting the ends seal to the lower pultrusion 10. The connecting rod 9 extends through a cam block 14 that is seated in a glide shoe 12 and is movable along the glide shoe 12. The glide shoe 12 is connected to the lower pultrusion 10 by one or more fasteners 20. The cam block 14 and connecting rod 9 are in communication by one or more set screws 17. The cam block 14 further includes a groove 76 on each side that receives a guide key 15. The guide key 15 is connected to an upper pultrusion assembly 30 and in communication with the groove 76 by one or more fasteners 20 so that as the cam block 14 moves the orientation of the guide key 15 and upper pultrusion assembly 30 is changed without cross-machine 200 movement of the upper pultrusion assembly 30 and the lower pultrusion assembly 10. The upper pultrusion assembly 30 includes an upper pultrusion 25 that supports a fail surface 60A. The upper pultrusion 25 includes a front side 25A and a rear side 25B that are aligned in the machine direction 210 so that paper passes the front side 25A and then the rear side 25B. The front side 25A as illustrated includes a scraper and scraper seal 18 that is connected by a plurality of fasteners 20 so that the scraper 18 prevents contaminants, filler, paper fibers, or the like from entering a gap between the upper pultrusion 30 and the lower pultrusion 10.

Figure 1B:
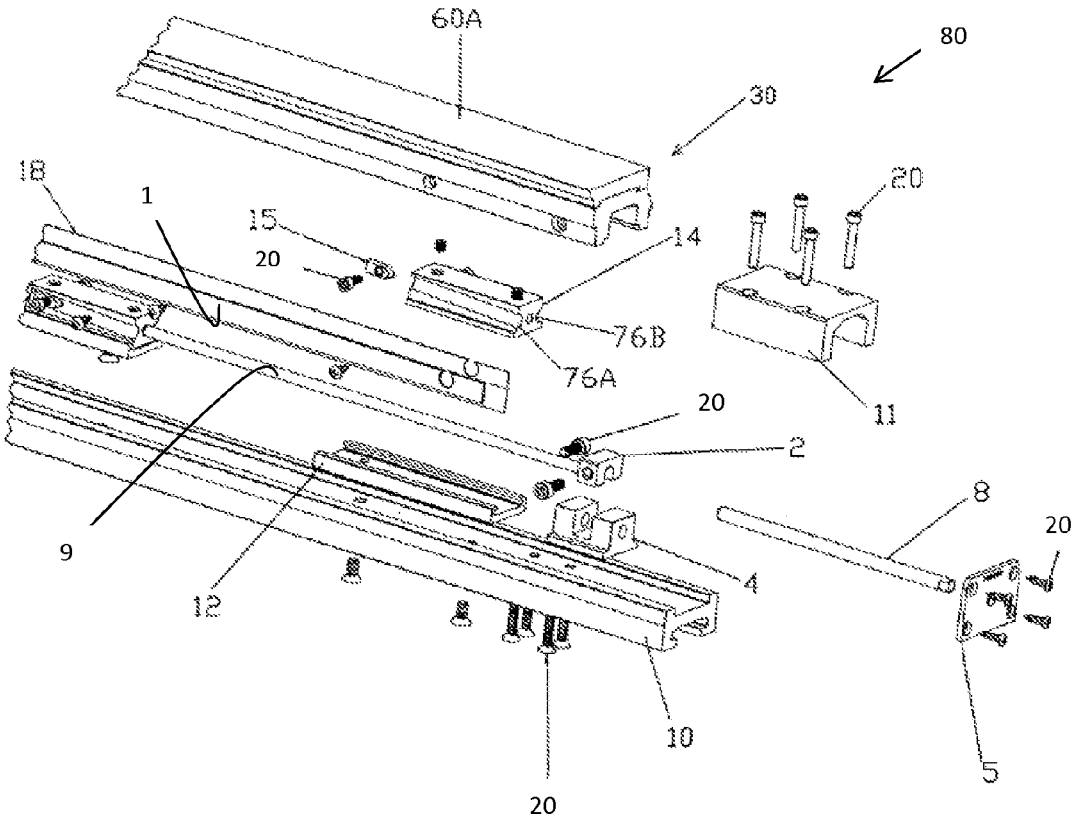
FIG. 1B illustrates a partial exploded view of the foil angle adjustment mechanism taken from an end opposite the one shown in FIG. 1A.

FIG. 1B illustrates an exploded view of an example of an end of an angle or height adjustable mechanism 80. The end does not include device for adjusting the height or angle of the upper pultrusion assembly 30 but includes an indicator rod 8 for indicating the relative adjustment of the upper pultrusion assembly 30. The angle or height adjustable mechanism 80 include glide shows 12 and a thrust end block 4 that are connected to the lower pultrusion 10 via fasteners 20. The thrust end block 4 receives a upper pultrusion pivot thrust block 2 and the thrust end block 4 and pivot thrust block 2 provide a pathway for indicator rod 8 to connect to rod 9. The pivot thrust block 2 has an open bottom so that the pivot thrust block may move up and down during height and/or angle adjustment but is prevented from laterally moving by the thrust end block 4. The indicator rod 8 extends through an end plate 5 that is connected to the upper pultrusion assembly 30 and/or the lower pultrusion 10 by fasteners 20. FIG. 1B illustrates a plurality of cam blocks 14 are connected to the connecting rod 9. The cam blocks 14 include a groove 76A on a front side and a groove 76B on a rear side that each extend at an angle and receive a guide key 15. The guide keys 15 are retained within the grooves 76A and 76B via a fastener 20. An end seal 11 extends over the thrust end block 4 and related parts and is connected to the lower pultrusion 10 by fasteners 20 so that the end seal 11 assists in maintaining the thrust end block 4 and related parts in position. An upper pultrusion assembly 30 extends over and is connected to the cam block 14 and associated components and so that movement of the cam block 14 changes the orientation of the upper pultrusion assembly 30 and ultimately the orientation of the foil surface 60. As is illustrated in this view a scraper 18 is connected to and extends along a front side of the angle or height adjustable mechanism 80 by a holder 1 and fasteners 20.

Figure 1C:
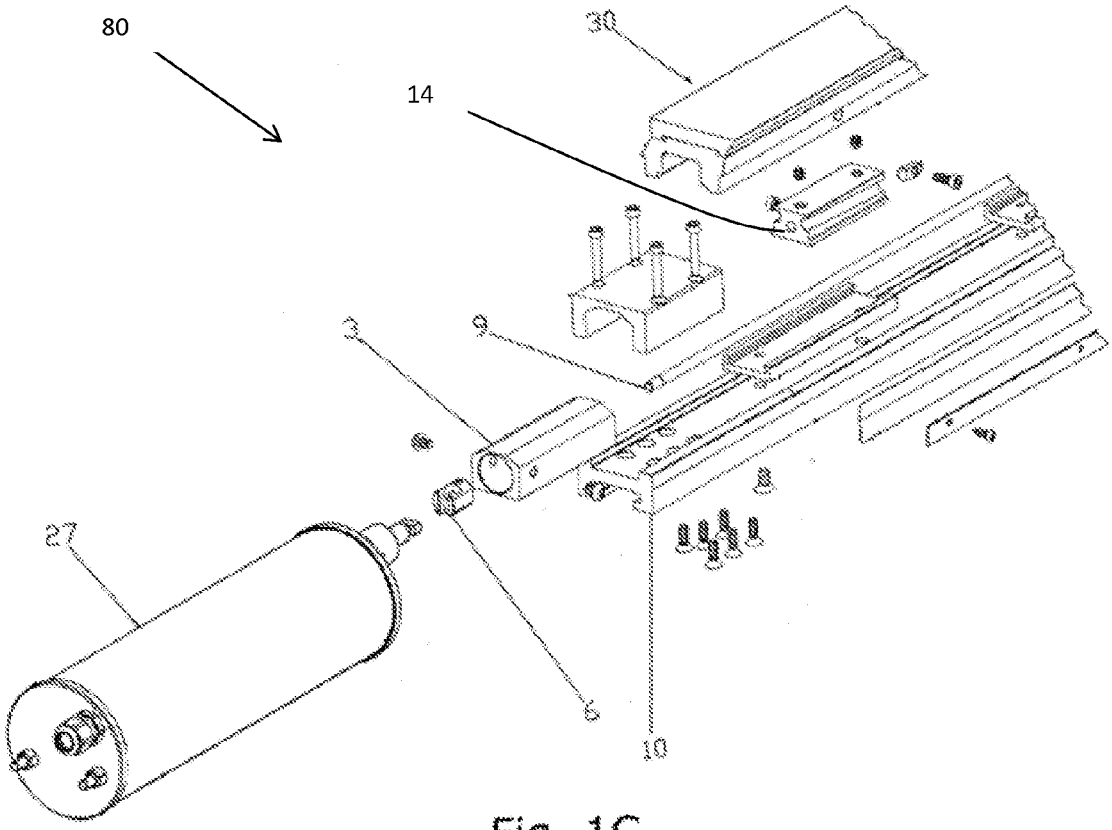
FIG. 1C shows an automated embodiment having a pneumatic, hydraulic or electric motor that controls either the height or angle of a foil and taken from the drive end.

FIG. 1C illustrates another example of an angle or height adjustment mechanism including a motor 27 for actuating the upper pultrusion assembly 30. The motor 27 is connected to a coupler 6 that is housed in a drive adaptor 3. The coupler 3 is connected to a connecting rod 9 so that movement of the motor 27 moves the connecting rod 9. The connecting rod 9 extends between the lower pultrusion 10 and the upper pultrusion assembly 30 and actuates the cam block 14 so that the upper pultrusion assembly 30 is moved.

Figure 2:
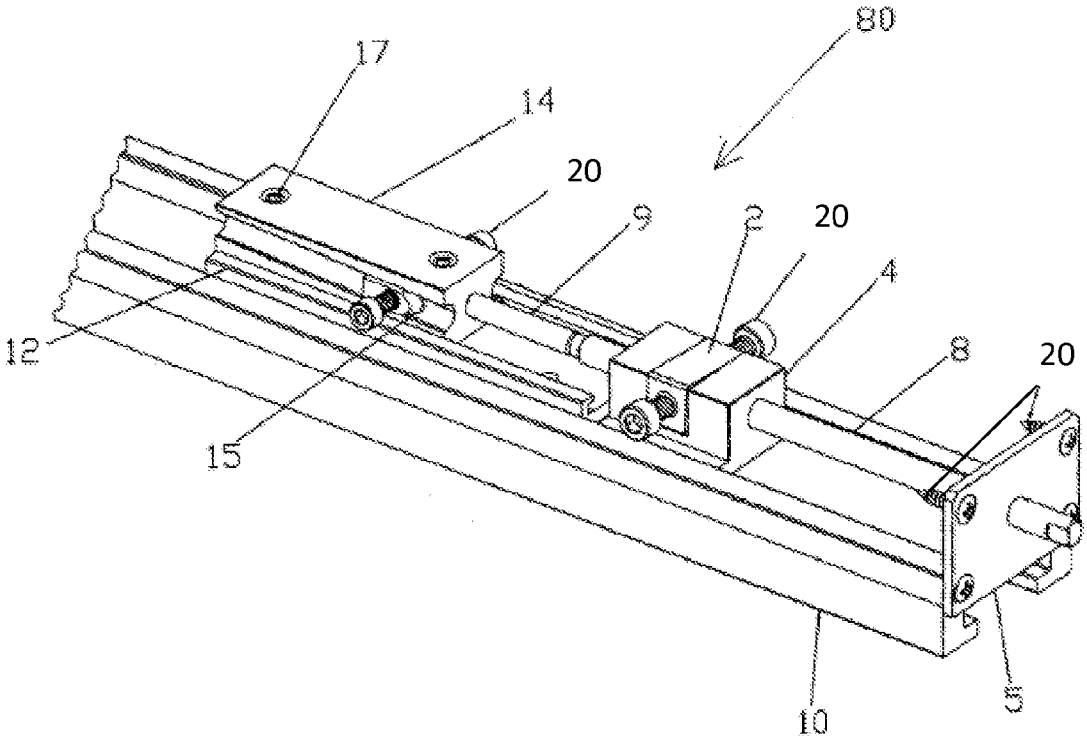
FIG. 2 is a perspective view of the constructed lower pultrusion assembly including a substantial portion of the angle or height adjustment mechanism and showing the working relationship between the guide keys and the cam blocks.

FIG. 2 illustrates an end of the angle or height adjustment mechanism 80 opposite an actuation device (not shown). The angle or height adjustment mechanism 80 includes an end cap 5 connected to the lower pultrusion 10 by fasteners 20. An end region of an indicator rod 8 extends at least partially through the end cap 5. The indicator rod 8 is in communication with connecting rod 9. The connecting rod 9 is connected to a cam block 14 that actuates an upper pultrusion 25 (not shown) via fasteners 20. The connecting rod 9 is directly connected to an indicator rod 8. The connecting rod 9 and the indicator rod 8 extend into a thrust end block 4 and a thrust pivot block 2 that are in communication. The thrust end block 4 is connected to the lower pultrusion 10 via fasteners (not shown) and the pivot thrust block 2 is connected to the upper pultrusion 25 via fasteners 20. During operation the connecting rod 9 and the indicator rod 8 move in the cross machine direction and the pivot thrust block 2 being in communication with the thrust end block 4 prevents the upper pultrusion 25 from moving in the cross machine direction so that the upper pultrusion 25 only adjusts in height or angle. The cam block 14 is housed in a glide shoe 12 that allows for translation of the cam block 14 within the glide shoe 12. The cam block 14 includes a groove 76 on each side that each receive a guide key 15 that assists in actuating the upper pultrusion 25 (not shown). The cam block 14 is connected to the connecting rod 9 by set screws 17 so that the connecting rod 9 moves the cam block 14.

Figure 3A:
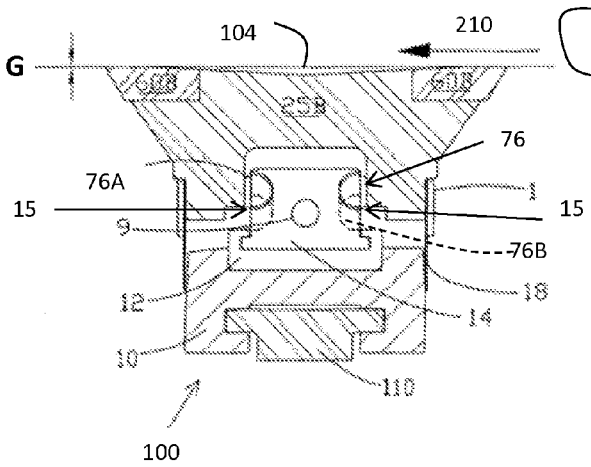
FIG. 3A shows an end view of the height adjustable embodiment taken from an end of a glide shoe and cam block so that the blade is in contact with a wire.
Figure 3B:
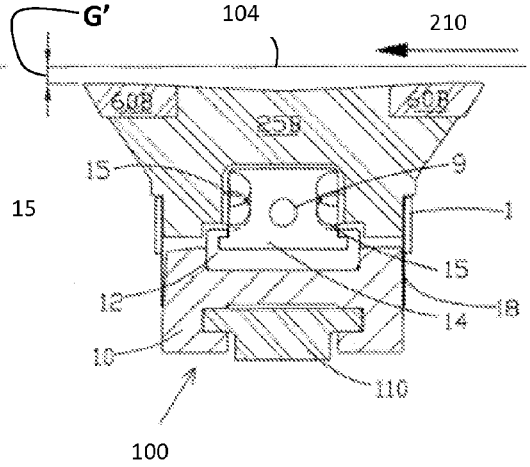
FIG. 3B shows the same end view as FIG. 3A with the height adjusted so that the blade is below the paper sheet.

FIGS. 3A and 3B illustrate a cross-sectional view of one example of a height adjustable device 100 located under a wire 104, that moves in the machine direction 210, with the height raised in FIG. 3A and the height lowered in FIG. 3B. In FIG. 3A the upper pultrusion 25B and opposing foil surfaces 60B are elevated into contact with the wire 104 so that there is no gap present. The upper pultrusion 25B includes a channel that receives a cam block 14 that moves the upper pultrusion 25B. The cam block 14 includes an aperture for receive a connecting rod 9 and grooves 76 on opposing sides. The grooves 76 as shown have a proximate end 76A that is located higher than the distal end 76B. As illustrated, the guide key 15 is located in the proximate end 76A so that as the cam block 14 is moved within the glide shoes 12 the upper pultrusion 25B is moved toward and substantially into contact with the wire 104 so that a gap (G) therebetween is eliminated and/or substantially eliminated. A holder 1 supports a scraper 18 that extends between the upper pultrusion 25B and the lower pultrusion 10. The base of the lower pultrusion 10 includes a channel for receiving a T-bar 110 of a support so that the height adjustable device 100 is connected within a forming section of a paper machine (not shown)

FIG. 3B illustrates the guide key 15 moved to the distal end 77B of the cam block 14 so that the upper pultrusion 25B is moved away from the wire 104 and a gap (G') is formed between the wire 104 and the foil surfaces 60B and the upper pultrusion 25B.

Figure 4A:
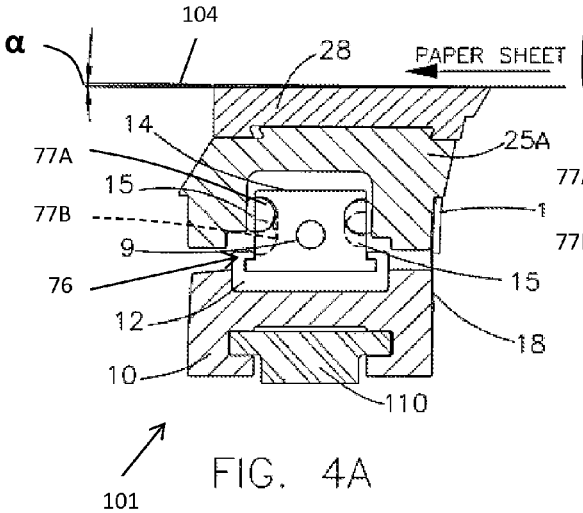
FIG. 4A shows an end view of the angle adjustable embodiment taken from an end of a glide shoe and cam block and with a trailing edge of the foil at an angle (a).
Figure 4B:
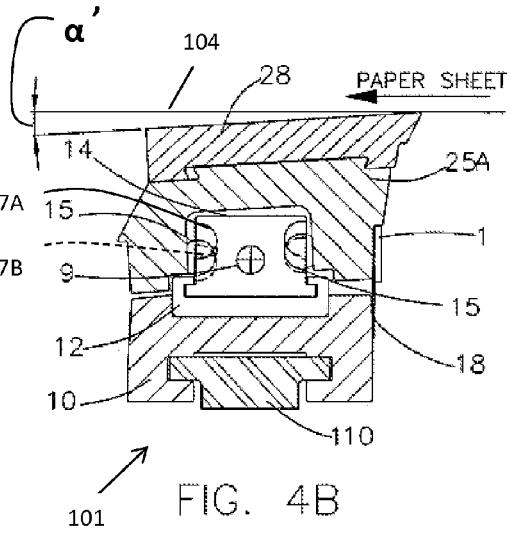
FIG. 4B shows the same end as FIG. 4A with the angle adjusted to angle (a').

FIGS. 4A and 4B illustrate a cross-sectional view of one example of an angle adjustable device 101 located under a wire 104 with the angle raised in FIG. 4A and the angle lowered in FIG. 4B, FIG. 4A illustrates a foil 28 and a wire 104 having an angle ($\alpha$) therebetween. The foil 28 is connected to an upper pultrusion 25A. The upper pultrusion 25A includes a cavity that houses a cam block 14. The cam block 14 includes a aperture for receiving a connecting rod 9 and a groove 76 on each side. The groove includes a proximal end 77A and a distal end 77B, and the groove extends at an angle between the proximal end 77A and the distal end 77B. FIG. 4A illustrates a guide key 15 located in the proximal end 776A of the cam block 14 so that the foil 28 is moved into contact with the wire 104 and in FIG. 4A the guide key 15 is located in the distal end 77B so that one end of the foil 28 is angled away from the wire 104. The cam block 14 is movably connected to a glide shoe 12 that includes a channel for retaining the cam block 14 so that the cam block 14 is movable along the glide shoe. The glide shoe 12 is connected to a lower pultrusion 10 so that the glide shoe 12 and cam block 14 are retained within the angle adjustment device 101. The base of the lower pultrusion 10 includes a channel for receiving a T-bar 110 of a support so that the adjustable device 101 is connected within a forming section of a paper machine (not shown). The adjustable device 101 includes a scraper and seal 18 that is connected between the upper pultrusion 25A and the lower pultrusion 10 by a holder. As is illustrated the scraper and seal 18 is located on the upstream side of the adjustable device 101 so that as water and residual stock are removed by the foil 28 the scraper 18 substantially prevent water and stock from entering a gap between the upper pultrusion 25A and the lower pultrusion 10.

FIG. 4B illustrates the guide keys 15 located in the distal end 77B of the grooves 76 in the cam block 14. The downstream side of the grooves 76 at the distal end 77B is lower than the proximal end 77A so that that as the guide key 15 is moved from the proximal end 77A to the distal end 77B an angle ($\alpha'$) is formed between the wire 104 and the foil 28.

Figure 5A:
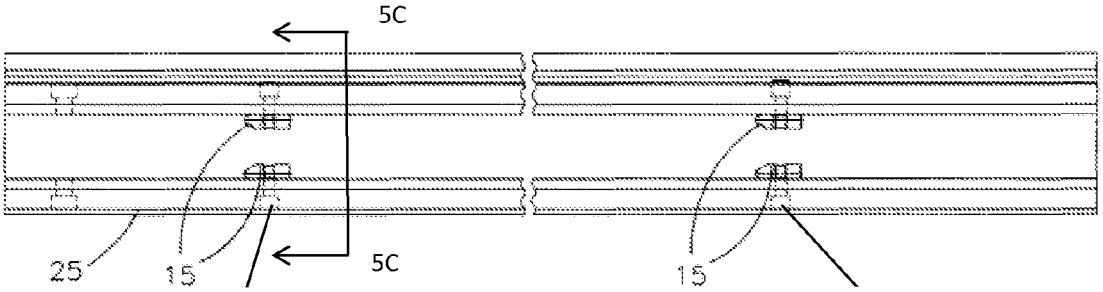
FIG. 5A shows a bottom view of the upper pultrusion assembly in an angle adjustable embodiment.

FIG. 5A illustrate a bottom up view of an upper pultrusion 25 having a pair of guide keys 15 connected by fasteners 20.

Figure 5B:
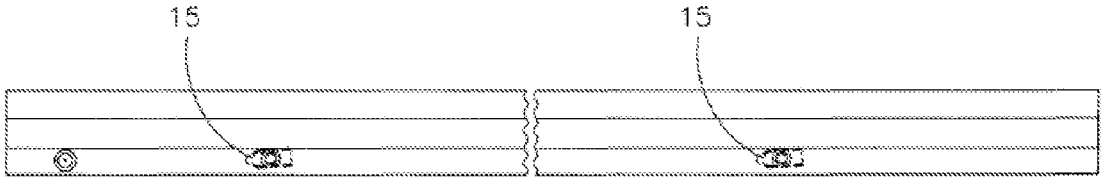
FIG. 5B is a side or edge view of the upper pultrusion assembly.

FIG. 5B illustrates a side view of a guide key 15 connected to the upper pultrusion 25.

Figure 5C:
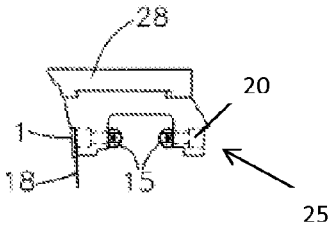
FIG. 5C is an end view of the upper pultrusion assembly.

FIG. 5C illustrates a cross-sectional view of an upper pultrusion 25 of FIG. 5A along line 5C-5C. The upper pultrusion 25 includes a foil 28 with a pair of fasteners 20 connecting guide keys 15 to the upper pultrusion 25. A scraper seal 18 is connected to a front side of the upper pultrusion 25 by a holder 1 and a fastener 20.

Figure 6A:
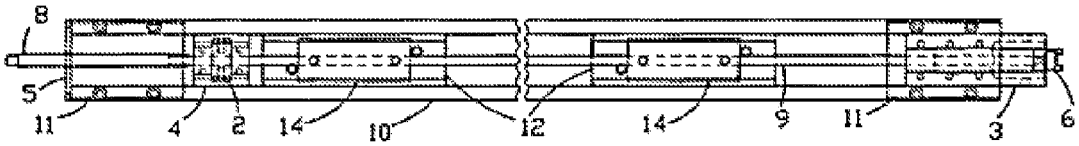
FIG. 6A shows an overhead view of the lower pultrusion assembly.
Figure 6B:
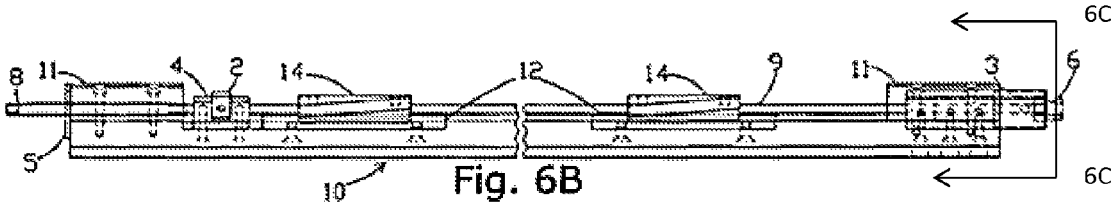
FIG. 6B shows a side view of the lower pultrusion assembly taken from an edge of the glide shoe and cam block.

FIG. 6A illustrates a top view of both ends of a lower pultrusion 10 including elements for moving an upper pultrusion 25 (not show) and FIG. 6B illustrates a side view of FIG. 6A. Glide shoes 12 are connected to the lower pultrusion 10 and a cam block 14 is movingly connected in the glide shoes 12. A connecting rod 9 connects the cam blocks so that the cam blocks 14 move in unison. The connecting rod 9 on one end is connected to an end thrust block 4 that includes a pivot thrust block 2 and the end block 4 and pivot thrust block 2 connect the connecting rod 9 to an indicator rod 8 so that a user can determine the amount of movement of the upper pultrusion 25 (not shown). The indicator rod 8 extends through an end plate 5 and an end seal 11 that seals the end of the height and angle adjustment mechanism and aligns the indicator rod 8. The opposing end includes an end seal 11 that houses a drive adapter 3 and coupler 6 so that when an actuation device (not shown) is connected to the coupler 6 power is transmitted from the coupler 6 to the drive adapter 3 and then to the connecting rod 9.

Figure 6C:
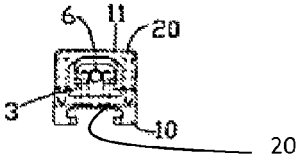
FIG. 6C is an end view of the lower pultrusion assembly.
Figure 7:
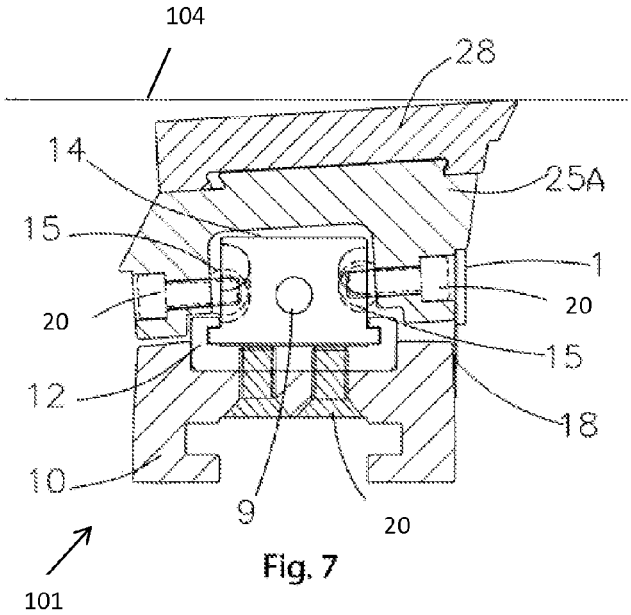
FIG. 7 is a section view of the foil adjustment mechanism in an angle adjustment embodiment.

FIG. 6C illustrates an end view of FIG. 6B along lines 6C-6C. The end of the lower pultrusion 10 includes an end seal 11 that is connected by fasteners 20. The end seal 11 houses a drive adapter 3 and a coupler 6 far receiving an actuation device (not shown), FIG. 7 illustrates an angle adjustment device 101 with a rear end angled away from a wire 104 and a forward end is on contact with the wire 104. The angle adjustment device 101 includes an upper pultrusion 25A having a foil 28 that contacts the wire 104. The upper pultrusion 25A is connected to a pair of guide keys 15 by a fastener 20. The guide keys 15 are connected to a cam block 14 that includes an aperture for receiving a connecting rod. The front side of the angle adjustment device 101 includes a scraper 18 and holder 1 for preventing paper stock from entering the angle adjustment device 101. The cam block 14 is movably connected to the lower pultrusion 10 by a glide shoe 12. The glide shoe 12 is connected to the lower pultrusion 10 by a plurality of fasteners 20.

Figure 8A:
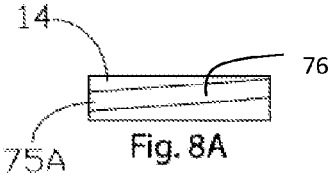
FIG. 8A is an elevated plan view of the leading edge of a cam block in the height adjustment embodiment of the invention.
Figure 8B:
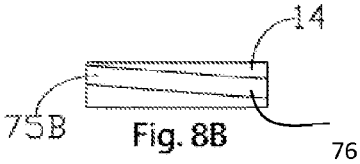
FIG. 8B is an elevated plan view of the trailing edge of the cam block shown in FIG. 8A.

FIGS. 8A and 8B show both sides of a cam block 14 for a height adjustable device. A first side 75A of the cam block 14 and the second side 75B of the cam block 14 have grooves 76 having substantially the same angle so that both sides of the upper pultrusion (not shown) are equally moved up and down by movement of the cam block 14.

Figure 9A:
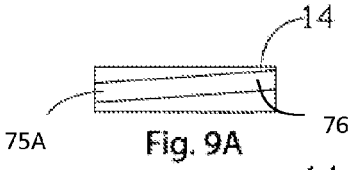
FIG. 9A is an elevated plan view of the leading edge of a cam block in the angle adjustment embodiment of the invention.
Figure 9B:
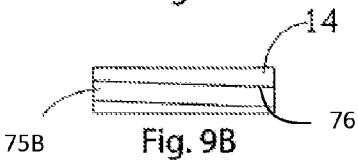
FIG. 9B is an elevated plan view of the trailing edge of the cam block shown in FIG. 9A.

FIGS. 9A and 9B show both sides of a cam block 14 for an angle adjustable device. A first side 75A of the can block 14 and the second side 75B of the cam block 14 have grooves 76 having different angles. The first side 75A has a steep angle for moving the rear side of the upper pultrusion as is illustrated in FIG. 7. The second side 75B has a groove 76 having a small angle so that the front side of the upper pultrusion is free of movement.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

We claim:

1. An adjustment mechanism comprising:

a. a lower pultrusion;

b. an upper pultrusion; and c. a plurality of cam blocks located between the lower pultrusion and the upper pultrusion, each of the plurality of cam blocks including:

i. a groove on a first side extending from a proximal end to a distal end of the cam block, and ii. a groove on a second side extending from a proximal end to a distal end of the cam block;

d. a pair of guide keys arranged on opposing sides of each of the plurality of cam blocks so that one of the pair of guide keys is located in the groove on the first side and one of the pair of guide keys is located in the groove on the second side, wherein the pair of guide keys are directly connected to the upper pultrusion and extend from the upper pultrusion into the groove on the first side and the groove on the second side respectively so that as the cam blocks move the guide keys move longitudinally within the grooves;

wherein the groove on the first side and the groove on the second side include open ends:

wherein the plurality of cam blocks are longitudinally movable relative to the lower pultrusion and the upper pultrusion so that as the plurality of cam blocks longitudinally move, at least a portion of the upper pultrusion moves relative to the lower pultrusion.

2. The adjustment mechanism of claim 1, wherein the upper pultrusion and the lower pultrusion are free of longitudinal movement during longitudinal movement of the plurality of cam blocks.

3. The adjustment mechanism of claim 1, wherein the adjustment mechanism is height adjustable, angle adjustable, or both.

4. The adjustment mechanism of claim 1, wherein each of the guide keys slides within the grooves during longitudinal movement of the cam blocks. relative to the lower pultrusion and the upper pultrusion.

5. The adjustment mechanism of claim 1, wherein the proximal end is higher than the distal end of the groove on the first side of the cam block and the proximal end is higher than the distal end of the groove on the second side of the cam block so that an angle is formed between the proximal end and the distal end; and the groove on the first side and the groove on the second side are substantially parallel or substantially non-parallel.

6. The adjustment mechanism of claim 1, wherein during movement of the guide key within a respective groove the guide key cleans material from the one or more grooves.

7. The adjustment mechanism of claim 1, wherein the plurality of cam blocks are connected via one or more connecting rods that extend along a longitudinal axis of the upper pultrusion and the lower pultrusion and wherein the one or more connecting rods simultaneously move the plurality of cam blocks along the longitudinal axis during adjustment of the upper pultrusion relative to the lower pultrusion.

8. The adjustment mechanism of claim 1, wherein the adjustment mechanism includes one or more glide shoes for movingly connecting the plurality of cam blocks to the lower pultrusion so that the plurality of cam blocks are movable formed between the proximal end and the distal end; and the groove on the first side and the groove on the second side are substantially parallel or substantially non-parallel.

9. The adjustment mechanism of claim 8, wherein the one or more glide shoes are fixedly connected to the lower pultrusion and the lower pultrusion includes a channel for receiving the plurality of cam blocks so that the cam blocks are fixedly connected to the lower pultrusion.

10. The adjustment mechanism of claim 1, wherein a holder extends between the upper pultrusion and the lower pultrusion and covers any space located between the upper pultrusion and the lower pultrusion so that fluid, fiber, fines, chemicals, fillers, or a combination thereof are substantially prevented from entering the space between the upper pultrusion and the lower pultrusion.

11. The adjustment mechanism of claim 1, wherein the adjustment mechanism includes:

a. a thrust end block connected to the lower pultrusion, and b. a pivot thrust block connected to the upper pultrusion and being in communication with the thrust end block so that movement of the upper pultrusion is prevented in a cross machine direction.

12. The adjustment device of claim 11, wherein the thrust end block and the pivot thrust block connect an indicator rod to a connector rod so that movement of the connector rod along its axis moves the indicator rod along its axis.

13. An adjustment mechanism comprising:

a. a lower pultrusion, b. an upper pultrusion; and c. a plurality of cam blocks located between the lower pultrusion and the upper pultrusion;, each of the plurality of cam blocks including:

i. a groove on a first side extending from a proximal end to a distal end of the cam block. and ii. a groove on a second side extending from a proximal end to a distal end of the cam block;

wherein the groove on the first side and the groove on the second side include open ends;

wherein the plurality of cam blocks are longitudinally movable relative to the lower pultrusion and the upper pultrusion so that as the plurality of cam blocks longitudinally move, at least a portion of the upper pultrusion moves relative to the lower pultrusion; and wherein the distal end and the proximal end of the groove on the first side of the cam block are located substantially within a same plane and the distal end of the groove on the second side of the cam block located below the proximal end so that as the cam block is moved the groove in the first side substantially maintains the position of the upper pultrusion and the groove in the second side moves the upper pultrusion as the cam block is moved.

14. The adjustment mechanism of claim 13, wherein each of the one or more grooves include a guide key that extends from and is direclty connected to the upper pultrusion and during movement of the guide key within a respective groove the guide key cleans material from the one or more grooves.

15. The adjustment mechanism of claim 13, wherein each of the plurality of cam blocks are connected to a connecting rod and one of the connecting rods is in communicaiton with a thrust end block and pivot end block, and the pivot end block is at least partially located with the thrust end block so that the pivot end block is movable up and down relative of the end thrust block, but the pivot end block prevents cross-machine movement of the upper pultrusion relative to the end thrust block.

16. An adjustment mechanism comprising:

a. a lower pultrusion including:

i. one or more recesses for receiving a portion of a paper machine;

b. one or more glide shoes in communication with the lower pultrusion;

c. a plurality of cam blocks in communication with the one or more glide shoes, wherein the plurality of cam blocks are movable along the one or more glide shoes and the lower pultrusion, each of the plurality of cam blocks comprising:

i. a groove on a first side extending from a proximal nd to a distal end of the cam block and ii. a groove on a second side extending from a proximal end to a distal end of the cam block;

d. one or more connecting rods extending along a longitudinal axis of the adjustment mechanism and connecting each of the plurality of cam blocks;

e. guide keys located on the first side and the second side of the cam block, wherein one guide key extends into each of the grooves of the plurality of cam blocks;

f. an upper pultrusion connected to the guide keys and in communication with the plurality of cam blocks via the guide keys;

g. a thrust end block connected to the lower pultrusion and in communication with one of the one or more connecting rods;

h. a pivot thrust block in communication with the thrust end block, and the pivot thrust block being in communication with the connecting rod that is in communicaiton with the thrust end block; and i. a foil in communication with the upper pultrusion;

wherein during adjustment of the upper pultrusion the plurality of cam blocks are moved along the longitudinal axis and an orientation of the guide keys are changed so that the upper pultrusion is adjusted without the upper pultrusion moving along the longitudinal axis.

17. The adjustment mechanism of claim 16, wherein the one or more glide shoes are connected to the lower pultrusion via a plurality of fasteners, the one or more glide shoes are an integral part of the lower pultrusion, or both.

18. The adjustment mechanism of claim 16, wherein the groove on the first side and the groove on the second side are substantially parallel so that a height of the upper pultrusion is adjusted.

19. The adjustment mechanism of claim 16, wherein the grooves have open ends so that the grooves are cleaned by the glide shoes during movement of the glide shoes along the longitudinal axis.

20. The adjustment mechanism of claim 16, wherien the pivot end block is located with the end thrust block and the pivot end block is movable up and down relative to the end thrust block but cross-machine movement of the upper pultrusion is prevented relative to the end thrust block.

* * * * *

UNITED STATES PATENT AND TRADEMARK OFFICE

CERTIFICATE OF CORRECTION

PATENT NO. : 9,045,859 B2
APPLICATION NO. : 14/159779
DATED : June 2, 2015
INVENTOR(S) : Alex Gauss It is certified that error appears in the above-identified patent and that said Letters Patent is hereby corrected as shown below:

In the Claims

Column 17, Line 25, Claim 4, Remove "relative to the lower pultrusion and the upper pultrusion"

Signed and Sealed this
Twenty-second Day of September, 2015

Michelle K. Lee

Michelle K. Lee
*Director of the United States Patent and Trademark Office*